US012454960B2

(12) United States Patent
Orlandini et al.

(10) Patent No.: US 12,454,960 B2
(45) Date of Patent: Oct. 28, 2025

(54) ELECTRIC FAN FOR AN AIRCRAFT

(71) Applicant: SAFRAN VENTILATION SYSTEMS, Blagnac (FR)

(72) Inventors: Fabien Orlandini, Moissy-Cramayel (FR); Frederic Garcia, Moissy-Cramayel (FR)

(73) Assignee: SAFRAN VENTILATION SYSTEMS, Blagnac (FR)

( * ) Notice: Subject to any disclaimer, the term of this patent is extended or adjusted under 35 U.S.C. 154(b) by 38 days.

(21) Appl. No.: 18/689,027

(22) PCT Filed: Sep. 6, 2022

(86) PCT No.: PCT/FR2022/051685
§ 371 (c)(1),
(2) Date: Mar. 4, 2024

(87) PCT Pub. No.: WO2023/037072
PCT Pub. Date: Mar. 16, 2023

(65) Prior Publication Data

US 2024/0401601 A1 Dec. 5, 2024

(30) Foreign Application Priority Data

Sep. 10, 2021 (FR) ..... 2109508

(51) Int. Cl.
*F04D 29/056* (2006.01)
*F04D 19/00* (2006.01)
(Continued)

(52) U.S. Cl.
CPC ..... *F04D 29/056* (2013.01); *F04D 19/002* (2013.01); *F04D 25/082* (2013.01); *F04D 29/0476* (2013.01); *F04D 29/0513* (2013.01)

(58) Field of Classification Search
CPC ..... F04D 19/002; F04D 29/0413; F04D 29/0476; F04D 29/051; F04D 29/0513;
(Continued)

(56) References Cited

U.S. PATENT DOCUMENTS 10,006,465 B2 6/2018 Agrawal et al.
10,724,544 B2 7/2020 Graham et al.
(Continued)

FOREIGN PATENT DOCUMENTS

FR 3029895 A1 6/2016

OTHER PUBLICATIONS

International Search Report received for PCT Patent Application No. PCT/FR2022/051685, mailed on Dec. 21, 2022, 7 pages (3 pages of English Translation and 4 pages of Original Document).

*Primary Examiner* — Kenneth J Hansen
(74) *Attorney, Agent, or Firm* — Womble Bond Dickinson (US) LLP

(57) ABSTRACT

A fan including a casing, a body defining, with the casing, a flow channel of an air flow, the body having an upstream cone, a central portion and a downstream cone, the downstream cone having at least a first opening, a shaft, a ventilation wheel, an electric motor, a first air bearing located upstream of the electric motor and supported by the upstream cone, a second air bearing located downstream of the electric motor, and a plurality of air passages are provided inside the body to direct the air flow from the first opening up to the upstream cone, the upstream cone including second openings for the air to pass through.

16 Claims, 5 Drawing Sheets

(51) Int. Cl.

| | |
|---|---|
| ***F04D 25/08*** | (2006.01) |
| ***F04D 29/041*** | (2006.01) |
| ***F04D 29/047*** | (2006.01) |
| ***F04D 29/051*** | (2006.01) |

(58) Field of Classification Search
CPC .... F04D 29/056; F04D 29/057; F04D 29/082; F04D 29/4253
See application file for complete search history.

(56) References Cited

U.S. PATENT DOCUMENTS

| | | | | |
|---|---|---|---|---|
| 2009/0115265 | A1 | 5/2009 | Leroy | |
| 2013/0129488 | A1 | 5/2013 | Agrawal et al. | |
| 2016/0169238 | A1 | 6/2016 | Stefanovic | |
| 2018/0066666 | A1* | 3/2018 | Colson ..... | B64D 13/06 |

* cited by examiner

ELECTRIC FAN FOR AN AIRCRAFT

TECHNICAL FIELD OF THE INVENTION

This invention relates to an electric fan. The invention also relates to an aircraft comprising such an electric fan.

TECHNICAL BACKGROUND

The prior art comprises in particular the documents US-B2-1000645 and US-A1-2013/129488.

Electric fans are known to be used on board various types of aircraft, particularly on board aeroplanes.

These fans are known for cooling various on-board items of equipment, such as on-board computers or other devices equipping the aircrafts. Other on-board fans contribute, for example, to the recirculation of air in the aircraft cabin. Generally speaking, the fan comprises an electric motor and a fan wheel secured to a rotating portion (i.e. a shaft line) of the electric motor. The fan shaft is supported by guide bearings. These bearings are typically ball rolling bearings and allow to ensure the rotation of the shaft of the fan. These ball rolling bearings are preferably greased for life, firstly to avoid lubricating the rollings with oil and having to manage a dedicated lubrication circuit, and secondly to avoid finding oil particles in the ventilation circuit. The disadvantage of these ball rolling bearings is their limited speed of rotation due to the presence of grease. The ball rolling bearings can generally be used for a fan running at a maximum speed of 24,000 rpm, beyond which friction on the bearings can affect their service life.

Another challenge in the field of the electric fans for the aeronautical industry is to significantly reduce their weight. For a given fan performance, the higher the speed of rotation of the fan wheel, the smaller its diameter will tend to be. In this way, the mass of the wheel will be reduced, and the mass of the other elements surrounding the wheel can also be reduced, such as the electric motor and its envelope. However, as described above, it is not possible to increase the speed of rotation beyond 24,000 rpm with rolling bearings, regardless of how they are lubricated.

To overcome these disadvantages, a different guide bearing technology is integrated on the shaft of the fan. More specifically, air guide bearings (more specifically sheet guide bearings) can be integrated on the shaft. These air bearings comprise flexible sheets and corrugated sheets positioned around the shaft of the fan to provide stiffness and damping to support the shaft once a minimum speed limit is reached. Below an initial shaft rotation speed value (for example around 3,000 rpm), there is dry contact between the sheets of the bearing and the shaft. During this contact period, the bearings will wear. Above a second speed value (e.g. around 10,000 rpm), the bearing sheets lift off the shaft. There will be no more contact between the sheets of the bearing and the shaft, and therefore no more wear on the air bearing. Between the first and the second gear, the friction will be reduced, with a slight friction and take-off/landing phases of the shaft line on the bearings.

Although this fan configuration with the air bearings allows to reduce or eliminate wear on the air bearings during operation, it does pose a number of difficulties, in particular pressure drops due to air shear between the sheets of the bearing and the shaft. These pressure drops can lead to a heat build-up and a thermal heating, which can damage the air bearings.

In this context, it is interesting to overcome the disadvantages of the prior art by proposing an electric fan for an aircraft that is reliable and has an improved service life.

SUMMARY OF THE INVENTION

The invention relates to an electric fan for an aircraft, comprising:

- a tubular casing extending along and around a longitudinal axis X,
- a body extending along the axis X and inside said casing, the body and the casing defining between them an annular flow duct for an air flow, the body comprising an upstream cone, a central segment and a downstream cone, the downstream cone comprising at least a first orifice for the passage of air from said duct inside said body,
- a shaft extending along the axis X and inside the body,
- a fan wheel carried by a first longitudinal end of the shaft,
- an electric motor mounted inside the body and around the shaft,
- a first guide air bearing for guiding the shaft located upstream of the electric motor and supported by the upstream cone,
- a first axial annular abutment connected to said central segment,
- a second air bearing for guiding the shaft located downstream of the electric motor and supported by said first axial abutment,
- a second axial annular abutment connected to the downstream cone, and
- an axial annular abutment disc supported by a second longitudinal end of the shaft opposite said first longitudinal end of the shaft.

According to the invention, several air passages are provided inside said body to convey said air flow from said first orifice to the upstream cone of the first air bearing, this upstream cone comprising second orifices for the passage of this air.

This fan configuration allows the assembly of the bearings upstream and downstream of the electric motor to be cooled effectively by a single air flow from downstream to upstream of the body of the fan. The rotation of the fan wheel generates an air flow with a first pressure F1 at the outlet of the wheel which is higher than a second pressure F2 of the same air flow (located at a distance from the wheel) due to the pressure drops present in the annular duct (e.g. by the presence of holes in the fan, the air friction against the walls of the fan and/or the presence of stator vanes). This creates a negative pressure in the annular air passage duct of the fan. The integration of the first and second orifices, respectively, on the upstream and downstream cones of the body, and the plurality of air passages inside the body, together with the presence of this negative pressure, allow the air flow coming from the annular duct to pass inside the body of the fan. This helps to cool the air bearings and in particular the air abutments of the fan. To achieve this, a cooling (or ventilation) circuit can be formed by the first and second orifices and the air passages which are preferentially located between the shaft and the elements (such as radial bearings, the electric motor, the axial abutments, etc.) surrounding this shaft inside the body. The cooling circuit allows to ventilate the air bearings and prevents a heat build-up, leading to thermal runaway. As a result, the service life of the air bearings (and therefore of the fan) is significantly improved.

In addition, the integration of the orifices and of the air passages of the fan according to the invention also allows to reduce the mass and the overall dimension of the fan in an aircraft.

The fan according to the invention may comprise one or more of the following characteristics, taken in isolation from each other or in combination with each other:

- the first guide air bearing is radial (in particular with respect to the axis X);
- the second guide air bearing is radial (in particular with respect to the axis X);
- the second guide air bearing is radial and has an axial abutment;
- the first axial annular abutment comprises at least one smooth sheet and at least one corrugated sheet;
- the second axial annular abutment comprises at least one smooth sheet and at least one corrugated sheet;
- the fan comprises:
  - a first air passage connecting said first orifice to the second air bearing,
  - a second air passage connecting the first air passage to the electric motor,
  - a third air passage connecting the second air passage to the first air bearing, and
  - a fourth air passage connecting the third air passage to the second orifices;
- said second air passage orifices are formed in a transverse wall of the upstream cone which is connected to the central segment of the body;
- the axial annular abutment disc is interposed between the first and second axial annular abutments;
- said second air bearing and said first axial annular abutment are formed in one-part;
- the air passages are formed by openings in the elements of the fan and/or gaps between the elements of the fan;
- the first axial annular abutment comprises a radial annular wall extending around the axis X;
- said radial wall comprises an annular shoulder and an annular radial flange extending downstream of said shoulder;
- the abutment disc extends around the axis X;
- the abutment disc comprises a radial extension, a first axial extension and a second axial extension which extend on either side of the radial extension;
- the first axial extension is connected to the second longitudinal end of the shaft;
- the abutment disc is hollow and comprises a bore;
- said second abutment is an annular part extending around the axis X and having a general C shape;
- the annular part of the second abutment comprises a vertical annular wall and a longitudinal annular wall extending axially downstream of this vertical wall;
- the vertical wall of the second abutment comprises a central opening;
- the second axial extension of the abutment disc fits into the central opening in the vertical wall of the second abutment;
- the shaft comprises a tie rod extending along the axis X and within a bore in the shaft;
- the tie rod is an elongated bar along the axis X;
- the bar of the tie rod extends between a third annular longitudinal end and a fourth T-shaped longitudinal end;
- the fan comprises an ogive-shaped annular end cap extending around said downstream cone, said end cap comprising at least one third orifice for the passage of air from said duct inside said body to said second orifices;
- the second air passage orifices are two to fifteen in number, for example three;
- each of said second orifices has a diameter of between 3 and 20 mm, for example 6 mm.

The invention also relates to an aircraft comprising at least one electric fan according to the invention.

BRIEF DESCRIPTION OF THE FIGURES

Further characteristics and advantages of the invention will become apparent from the following detailed description, for the understanding of which reference is made to the attached drawings in which.

DETAILED DESCRIPTION OF THE INVENTION

In general, in the following description, the terms "longitudinal" and "axial" refer to the orientation of structural elements extending in the direction of a longitudinal axis X. This axis X may be confused with an axis of rotation of a rotor. The terms "radial" or "vertical" refer to an orientation of structural elements extending in a direction perpendicular to the axis X. The terms "inner" and "outer", and "internal" and "external" are used in reference to a positioning relative to the axis X. Thus, a structural element extending along the axis X comprises an inner face oriented towards the axis X and an outer surface opposite its inner surface.

The aircrafts can comprise a ventilation system for a cockpit and/or a cabin. The aircrafts can also comprise an avionics bay comprising various electronic items of equipment that needs to be cooled by a ventilation system.

The ventilation system may form part of a larger aircraft environmental control system assembly. The environmental control system is configured to receive ambient air, condition this ambient air and supply conditioned air to various systems, such as the ventilation system of the cockpit or of the cabin.

Figure 1:
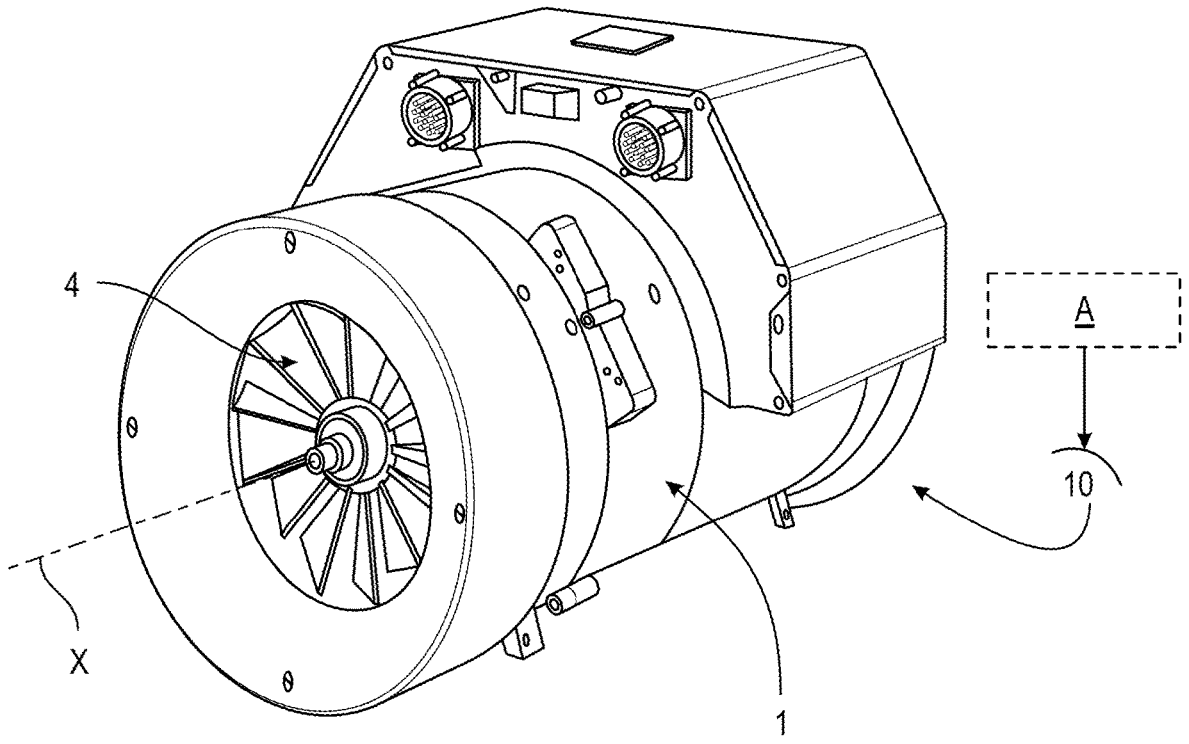
FIG. 1 is a schematic perspective view of an electric fan for an aircraft.

With reference to FIG. 1, in an aircraft A, the conditioned air can be supplied to the cockpit, to the avionic bay and/or to the cabin by means of an electric fan 10. FIGS. 2 to 5 illustrate a non-limiting embodiment of the fan 10 of the invention.

The fan 10 comprises several elements, such as a tubular casing 1, a body 2, a shaft 3, a fan wheel 4, an electric motor 5, a first guide air bearing 6, a second guide air bearing 7 and an axial annular abutment disc 86.

The casing 1 extends along and around a longitudinal axis X. In FIG. 1, the casing 1 is open at one of its longitudinal ends, in particular on the side of the fan wheel 4, in order to capture the air. This air captured by the wheel 4 can come from pre-conditioned air and channeled through an upstream pipe and/or a downstream pipe that can be integrated into the fan. For example, an ambient air can be captured by the wheel 4, in which case a filter is integrated into this pipe.

The body 2 also extends along the axis X and inside the casing 1. The body 2 and the casing 1 define between them an annular flow duct V for a main air flow. By way of example, the duct V has a first diameter Dv of between 80 and 140 mm. Preferably, the first diameter Dv is about 110 mm. The first diameter Dv is measured radially (with respect to the axis X) between the casing 1 and the body 2.

In the present application, the terms "upstream" and "downstream" are defined in relation to the orientation of circulation of the air flow in the fan, in particular from the fan wheel 4 (corresponding to upstream) towards an end of the fan opposite the wheel 4 (corresponding to downstream). More particularly, the air flow substantially upstream of the duct V (in particular at the outlet of the wheel 4) has a first pressure F1 and this same air flow downstream of the duct V (in particular at a distance from the wheel 4) has a second pressure F2. As described above, the first pressure F1 is higher than the second pressure F2, due to the pressure drops present in the duct V (for example through the presence of holes in the fan, the air friction against the walls of the fan and/or the presence of the stator vanes).

Figure 2:
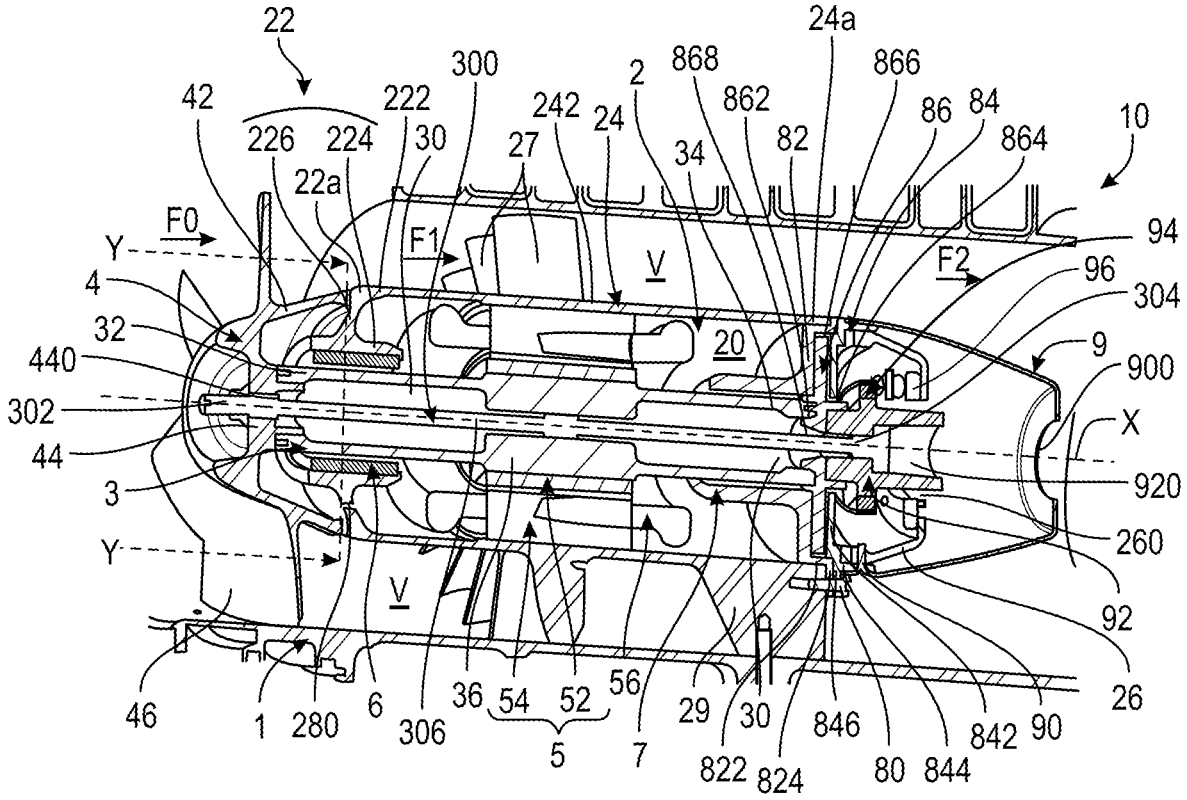
FIG. 2 is a schematic axial sectional view of the fan shown in FIG. 1 according to one embodiment of the invention.

The body 2 comprises an upstream cone 22, a central segment 24 and a downstream cone 26. In FIG. 2, the central segment 24 and the upstream cone 22 are formed in one-part.

In particular, the upstream cone 22 comprises an external annular portion 222, an internal annular portion 224 and a transverse annular wall 226 connecting the internal 224 and external 222 annular portions together. The external portion 222, the internal portion 224 and the transverse wall 226 can be monoblocs (i.e. integrally formed), as shown in FIG. 2.

The transverse wall 226 can extend, on the one hand, radially towards the outside of the internal portion 224, and on the other hand, radially towards the inside of an upstream annular edge 22*a* of the external portion 222. In the example shown in FIG. 2, an end opposite the upstream annular edge 22*a* is connected to the central segment 24.

The transverse wall 226 may be substantially inclined with respect to the axis X. The angle of inclination of the transverse wall 226 may be between 30° and 90°. In the example shown in FIG. 2, the transverse wall 226 is inclined at approximately 80° with respect to the axis X.

The internal portion 224 and the transverse wall 226 can therefore form a first annular support for the first bearing 6, so that the upstream cone 22 supports the first bearing 6. In particular, the internal portion 224 extends around the first bearing 6.

In the example, the wheel 4 is arranged upstream of the upstream cone 22. An annular air passage space 220 (FIG. 5) separates the upstream cone 22 from the wheel 4. By way of example, this space 220 is of the order of a few micrometres to a few millimetres.

The wheel 4 also extends around the axis X. The wheel 4 comprises a hub of revolution comprising an external conical wall 42 (relative to the axis X), an internal annular wall 44 and blades 46. The internal wall 44 is connected radially to the external wall 42 and axially to the shaft 3. In the example shown, the internal wall 44 comprises a first central bore 440 configured to receive at least a portion of a tie rod 300. The blades 46 each extend radially outwards from the external wall 42.

Figure 5:
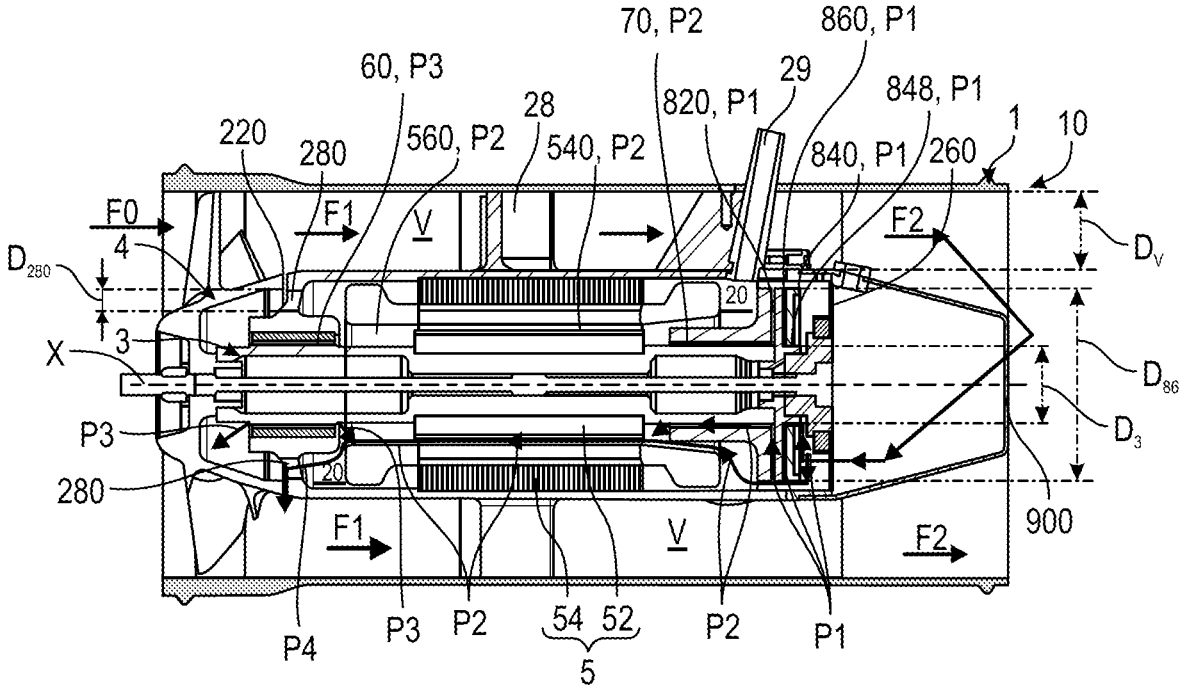
FIG. 5 is a schematic axial cross-sectional view of the fan shown in FIG. 2, illustrating a circulation of an air flow inside the fan according to one embodiment of the invention.

The central segment 24 may comprise a cylindrical wall which extends around the axis X. With reference to FIGS. 2 and 5, the central segment 24 extends substantially from the electric motor 5 to the second bearing 7. Blades 27 of stator vanes may extend radially outwards from the cylindrical portion of the central segment 24. These blades of stator vanes 27 are evenly distributed around the axis X. The blades of stator vane 27 may be located axially between the first bearing 6 and the second bearing 7.

The cylindrical portion of the central segment 24 may also comprise a free downstream annular edge 24*a*, which is notably opposite the upstream edge 22*a*. The downstream edge 24*a* is axially spaced from the downstream cone 26 in the example shown in FIG. 2.

The central segment 24 may also comprise a flange 29 for attaching the body 2 to the casing 1. In particular, the flange 29 extends radially from the cylindrical portion of the central segment 24, in particular from the downstream edge 24*a*. By way of example, the flange 29 and a fragment of the casing 1 are connected together by fasteners (such as screws).

In the example shown, the body 2 comprises an annular chamber 20. This chamber 20 is delimited by the external portion 222, the cylindrical portion of the central segment 24, the upstream 22 and downstream 26 cones.

The downstream cone 26 comprises at least one first orifice 260 configured for the passage of air from the duct V into the body 2.

The shaft 3 extends along the axis X and inside the body 2. The shaft 3 is a rotary or rotating shaft. In the example shown, the shaft 3 comprises a first longitudinal end 32, an opposite second longitudinal end 34 and a first median segment 36 connecting the first and second ends 32, 34 together. The first median segment 36 and the first and second ends 32, 34 are monobloc in the example. The first end 32 is supported by the first bearing 6 and the second end 34 is supported by the second bearing 7. The first bearing 6 and the second bearing 7 allow to support and guide the rotating shaft 3 in rotation. By way of example, the shaft 3 has a second diameter $D_3$ of between 15 and 25 mm, the second diameter being measured radially to the axis X. Preferably, $D_3$ is about 22 mm.

The shaft 3 may also comprise a second bore 30. In the example shown, the tie rod 300 is mounted in the second bore 30. In a variant not shown, the fan 10 comprises the shaft 3 without tie rod with or without a second bore 30.

The shaft 3 may be secured to the wheel 4. In particular, the first end 32 is connected to the internal wall 44 of the wheel 4. To do this, the internal wall 44 is inserted into the second bore 30.

The shaft 3 can also be secured to an axial annular abutment disc 86 downstream of the fan. More particularly, the second end 34 is connected to a first axial annular extension 862 of the abutment disc 86. To do this, the first extension 862 is inserted into the second bore 30.

The tie rod 300 can be an elongated bar. The tie rod 300 extends along the axis X and inside the shaft 3. In particular, the tie rod 300 is mounted inside the second bore 30 of the shaft, the first bore 440 of the internal wall 44, a third bore 868 of the abutment disc 86 and a fourth bore 920 of a support 92 of the fan 10. In the example shown, the tie rod 300 comprises a third longitudinal end 302, a fourth longitudinal end 304 opposite the third end 302 and a second median segment 306 connecting these third 302 and fourth 304 ends.

In the example shown, upstream of the fan 10, the wheel 4 and the first end 32 of the shaft extend around the third end 302 of the tie rod. To do this, the third end 302 is mounted in the first bore 440. This third end 302 may have a generally cylindrical shape. The third end 302 may have an allowance with respect to the thickness of the second median segment 306. Downstream of the fan, the abutment disc 86 and the support 92 extend around the fourth end 304 of the tie rod. To do this, the fourth end 304 is mounted in the third 868 and fourth 920 bores. In the example, the fourth end 304 is generally T-shaped and is mounted inside the support 92. The tie rod 300 has generally a support function for the assembly/disassembly of the various elements of the fan and to center the various elements of the fan.

The electric motor 5 is mounted inside the body 1 and around the shaft 3, in particular around the first median segment 36 of the shaft. The electric motor 5 may comprise a rotor 52 and a stator 54. The rotor 52 is generally cylindrical in shape and is mounted so that it can rotate about the axis X. The stator 54 extends around the rotor 52. The electric motor 5 may also comprise an active portion 56 (or winding) comprising armatures formed from ferromagnetic materials and windings wound around these armatures. In the example, the active portion 56 comprises a second opening 560 extending around the axis X. This active portion 56 extends through and on either side of the stator 54.

In the example, the first bearing 6 is located upstream of the electric motor 5, while the second bearing 7 is located downstream of the electric motor 5.

The first 6 and second 7 guide bearings are of the air (or sheet) type. These bearings 6, 7 can be a radial bearing and/or an abutment bearing allowing the shaft 3 to rotate relative to the body 2 on a film of fluid (such as air). In the example shown in FIGS. 2 and 5, the first bearing 6 is a radial bearing and the second bearing 7 is a radial bearing and an axial abutment bearing, in particular formed by a first annular axial abutment bearing 82.

Figure 3:
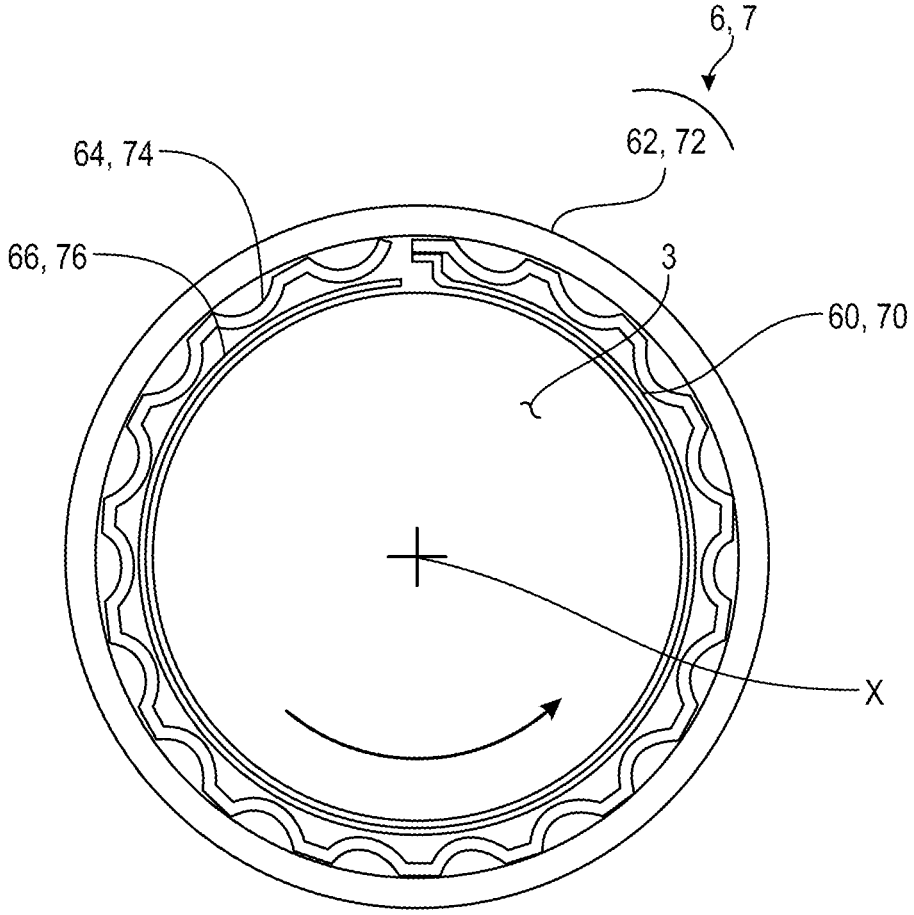
FIG. 3 is a schematic cross-sectional view of an air guide bearing of the fan in FIG. 2.

With reference to FIG. 3, each of the bearings 6, 7 may comprise an annular sleeve 62, 72, flexible sheets 64, 74 and corrugated sheets 66, 76. The corrugated sheets 66, 76 are interposed between the sleeve 62, 72 and the flexible sheets 64, 74. The flexible sheets 64, 74 are positioned around the shaft 3 of the fan. Air passages 60, 70 are also provided between the shaft 3 and the flexible sheets 64, 74. These passages 60, 70 (such as openings) are used in particular to cool the bearings and limit the heating of the bearings due to the shearing of the air between the sheets of the bearing and the shaft.

During operation, the shaft 3 is in rotation, in particular between a first speed and a second speed. As described in the technical background, the first speed (e.g. approximately 3,000 rpm) corresponds to the maximum contact speed of the sheets 64, 74 with the shaft 3. The second speed (e.g. approximately 10,000 rpm) corresponds to the minimum speed at which the sheets 64, 74 can be lifted off the shaft.

As mentioned above, the first bearing 6 is supported by the upstream cone 22, in particular by the internal portion 224 and the transverse wall 226. The second bearing 7 is supported by the first axial annular abutment 82.

Advantageously, the fan 10 also comprises the first annular axial abutment 82 and a second annular axial abutment 84. These axial abutments 82, 84 in particular allow the axial displacement of the shaft 3 to be maintained.

The first axial abutment 82 may be a radial annular wall. This radial annular wall may be generally C-shaped. The first axial abutment 82 may comprise an annular shoulder 822 and an annular radial flange 824. In FIG. 2, the radial flange 824 is interposed between the central segment 24 (in particular the downstream edge 24*a* and the downstream flange 29) and a second axial abutment 84. The second axial abutment 84, the downstream 29 and radial 824 flanges are connected by fasteners 80 (such as screws). In the example shown, the first axial abutment 82 can be formed in one-part (i.e. formed integrally) with the second bearing 7 to form a radial guide and axial abutment bearing (FIGS. 2 and 5).

The abutment disc 84 may comprise a radial annular extension 864 and first 862 and second 866 axial annular extensions. The first 862 and second 866 axial annular extensions extend on either side of the radial extension 864. The radial extension 864 is interposed between the first axial abutment 82 and the second axial abutment 84. In the example, the first extension 862 has a smaller external diameter than that of the second extension 866. As mentioned above, the first extension 862 fits into the second bore 30, and the second extension 866 fits into a first central opening 848 of the second abutment 84. By way of example, the abutment disc 86 may have a third external diameter $D_{86}$ of between 45 and 65 mm. Preferably, the third diameter $D_{86}$ is about 55 mm.

The fan 10 may also comprise the second abutment 84 mounted between the downstream cone 26 and the abutment disc 86. In the example shown, this second abutment 84 is an axial annular counter-abutment. The second abutment 84 may be an annular part having a generally C-shaped form. This part of the second abutment 84 may comprise a vertical annular wall 842 and a longitudinal annular wall 844 extending axially downstream of the vertical wall 842. The vertical wall 842 comprises the first opening 848. In FIGS. 2 and 5, this first opening 848 is defined between the abutment disc 86 and the second abutment 84 (in particular between the second extension 864 and the vertical wall 842). The vertical wall 842 extends substantially parallel to the radial extension 866 of the abutment disc 86 and to the first axial abutment 82. The longitudinal wall 844 comprises a second radial flange 846. This second radial flange 846 and the first radial flange 824 can be connected to the downstream flange 29 by fasteners 80 (such as screws). The longitudinal wall 844 can be connected to the downstream cone 26 by fasteners 90 (such as screws).

Advantageously, the first 82 and second 84 axial abutments are air (or sheet) abutment bearings. These axial abutments 82, 84 may be similar to the bearings 6, 7 in FIG. 3. The first axial abutment 82 and/or the second axial abutment 84 may comprise at least one smooth sheet and at least one corrugated sheet. In particular, the smooth sheet is in contact with the shaft 3, whereas the corrugated sheet is not in contact with the shaft 3 to allow the stiffness and damping functions of the first axial abutment 82. In the example shown in FIG. 2, the smooth and corrugated sheets are arranged on an upstream face of the vertical wall 842 of the second axial abutment 84.

The fan 10 can comprise a support 92 allowing for positioning and centering the tie rod 300 in relation to the downstream cone 26. To achieve this, the support 92 comprises the fourth bore 920 for receiving at least a downstream portion of the tie rod 300. This fourth bore 920 can thus have a complementary shape to the fourth longitudinal end 304 of the tie rod 300. The support 92 is secured to the abutment disc 86. Preferably, the support 92 is inserted inside the second extension 864. In particular, the support 92 is mounted inside the downstream cone 26. In the example, the first orifice 260 extends between the downstream cone 26 and the support 92.

The fan 10 may also comprise an annular end cap 9. The end cap 9 is ogive-shaped. The end cap 9 extends around the downstream cone 26. The end cap 9 comprises at least a third orifice 900. This third orifice 900 is configured for the passage of air from the duct V towards the interior of the body 2 and in particular as far as the upstream cone 22. In FIG. 2, the end cap 9 is connected to the second abutment 84 (in particular on the longitudinal portion 844) and to the downstream cone 26 by the fasteners 90.

The fan 10 may also comprise an annular magnet 94. This magnet 94 is mounted inside the downstream cone 26 and around the axis X. In FIGS. 2 and 5, the magnet 94 extends around the support 92. The magnet 94 is used to position the rotor 52 of the electric motor on the shaft 3. The position of the magnet 94 allow to determine the angular position of the rotor of the electric motor relative to the stator. This position of the rotor can be measured by Hall effect sensors in line with magnets 94 (not shown in the figures) and supported by a part 96.

One of the special characteristics of the invention lies in the fact that the upstream cone 22 (in particular the transverse wall 226) comprises second orifices 280 and that the body 2 comprises several air passages P1, P2, P3, P4.

Figure 4:
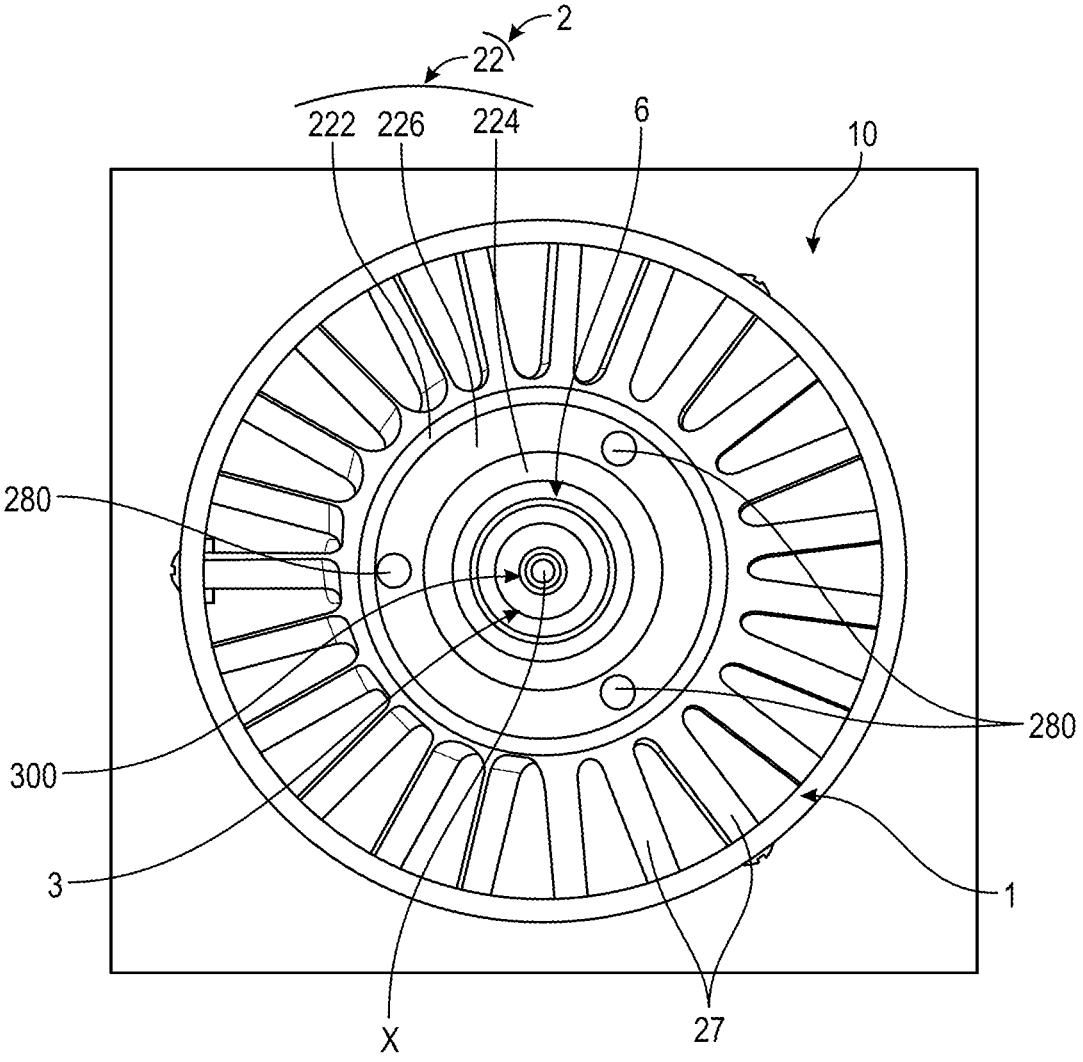
FIG. 4 is a schematic cross-section along the Y-Y line of FIG. 2.

With reference to FIGS. 2, 4 and 5, the transverse wall 226 comprises the second orifices 280. These second orifices 280 may be evenly distributed around the axis X. For example, there are between two and fifteen second orifices 280. Preferably, as shown in FIG. 4, there are three second orifices. Also by way of example, each of the second orifices 280 has a fourth diameter $D_{280}$ of between 3 and 20 mm. Preferably, the diameter $D_{280}$ of each of the second orifices is about 6 mm.

The various air passages P1, P2, P3, P4 according to the invention are defined by openings and/or spaces (or gaps) between the elements of the body 2 of the fan 10. More particularly, the body 2 comprises:

- a first air passage P1 connecting the first orifice 260 to the second bearing 7,
- a second air passage P2 connecting the first air passage P1 to the electric motor 5,
- a third air passage P3 connecting the second air passage P2 to the first bearing 6, and
- a fourth air passage P4 connecting the third air passage P3 to the second orifices 280.

In the example shown in FIG. 5, the first 82 and second 84 axial abutments and the abutment disc 86 are spaced apart by spaces suitable for the passage of air.

For example, these elements 82, 86 and 84 are a few micrometres to a few millimetres apart. A first gap 860 is thus defined between the abutment disc 86 and the second abutment 84. A second gap 820 is defined by the first abutment 82 and the abutment disc 86. The first 860 and second 820 gaps extend in a direction radial to the axis X. An annular cavity 840 may also be present around the first 82 and second 84 axial abutments and the abutment disc 86. This cavity 840 is in fluidic communication, on the one hand, with the first orifice 260 and, on the other hand, with the chamber 20 and the first and second interstices 860, 820. The cavity 840 and the first 860 and second 820 gaps can therefore form the first passage P1.

A third gap 540 may also be provided between the rotor 52 and the stator 54. This third gap 540 extends in a direction axial to the axis X. The second opening 560 of the active portion 56 is in fluidic communication, on the one hand, with the third gap 540 and, on the other hand, with the chamber 20 and a third opening 70 of the second bearing 7. In this way, the third 70 and second 560 openings and the third gap 540 can form the second passage P2.

The third passage P3 can be formed by the air flow leaving the second opening 560. This air flow enters a fourth opening 60 in the first bearing 6 and/or exits this fourth opening 60 in the direction of the chamber 20 in the body 2 and/or in the direction of the wheel 4.

The fourth passage P4 may be formed by the air flow leaving the second opening 560 or the fourth opening 60, and passing through the second orifices 280 to open into the annular duct V downstream of the wheel 4.

These passages P1, P2, P3, P4 allow to create a cooling (or ventilation or air circulation) circuit, particularly in a single direction from downstream to upstream, inside the chamber 20 of the body 2. This circuit preferably allows to cool the first and second guide bearings 6, 7 and the first and second axial abutments 82, 84, in order to limit pressure drops due to the air shear between the sheets of the bearings 6, 7 and the abutments 82, 84.

We will now describe the cooling circuit inside the body 2 of the fan 10 which is generated by the orifices 260, 280 and the air passages P1, P2, P3, P4, with reference to FIG. 5.

In operation, the fan 10 is supplied with an initial air flow F0 coming from the environment outside the fan and entering the fan 10 through the fan wheel 4. This initial air flow F0 is compressed by the blades 46 of the wheel 4 to generate the first air flow pressure F1 at the outlet of the wheel 4, which opens into the duct V of the fan. The air flow then passes through the blades of the stator vane 27 to reach a second pressure F2 of the same air flow. This second pressure F2 downstream of the duct V therefore has a lower pressure than the first pressure F1 upstream of the duct V. The air flow with the second pressure F2 passes inside the body 2 through the first orifice 260, and also through the third orifice 900 when the end cap 9 is mounted on the body 2. Inside the body 2, this air flow passes through the first passage P1 to cool the first and second axial abutments 82, 84, then this air flow passes through the second passage P2 so as to ventilate and cool the second bearing 7. At the outlet of the second passage P2, the air flow divides to pass into the third passage P3 to ventilate and cool the first bearing 6 and/or to pass into the fourth passage P4 by passing through the second orifices 280 to open into the duct V of the fan 10. This cooling circuit thus allows to provide the cooling necessary for the correct operation of the air bearings 6, 7 (and in particular the air abutments 82, 84) by a single inlet (via the first orifice 260) of a single source of air flow into the body 2.

In this description, the electric fan is described in an aircraft. The fan of the invention can also be adapted to the ventilation systems other than those used in the aeronautics.

Furthermore, it is understood from the present description that the ventilation efficiency of the guide bearings (such as reference parts 6 and 7) and/or axial abutments (such as reference parts 82 and 84) within the fan is dependent on various parameters, such as the dimensions (shape, size, materials, etc.) of the body of the fan and of the rotating shaft relative to the other elements of the fan.

Overall, this proposed solution is simple, effective and economical to carry out and to assemble on an electric fan, in particular on an aircraft, while ensuring an optimum operation and improved service life of the air bearings (and therefore also of the fan).

The invention claimed is:

1. An electric fan for an aircraft, comprising:

a tubular casing extending along and around a longitudinal axis, a body extending along the axis and inside said casing, the body and the casing defining between them an annular flow duct of an air flow, the body comprising an upstream cone, a central segment and a downstream cone, the downstream cone comprising at least a first orifice for the passage of air from said duct into said body, a shaft extending along the axis and inside the body, a fan wheel carried by a first longitudinal end of the shaft, an electric motor mounted inside the body and around the shaft, a first air bearing for guiding the shaft located upstream of the electric motor and supported by the upstream cone, a first axial annular abutment connected to the central segment, a second air bearing for guiding the shaft located downstream of the electric motor and supported by the first axial annular abutment, a second axial annular abutment connected to the downstream cone, and an axial annular abutment disc supported by a second longitudinal end of the shaft opposite said first end, wherein a plurality of air passages are provided inside said body to convey said air flow from said first orifice to the upstream cone of the first air bearing, this upstream cone comprising second orifices for the passage of this air, and said second air passage orifices are formed in a transverse wall of the upstream cone which is connected to the central segment of the body.

2. The fan according to claim 1, wherein the fan comprises:

a first air passage connecting said first orifice to the second air bearing, a second air passage connecting the first air passage to the electric motor, a third air passage connecting the second air passage to the first air bearing, and a fourth air passage connecting the third air passage to the second orifices.

3. The fan according to claim 1, wherein the axial annular abutment disc is interposed between the first and second axial annular abutments.

4. The fan according to claim 1, wherein said second air bearing and said first axial annular abutment are formed in one-part.

5. The fan according to claim 1, wherein the shaft comprises a tie rod extending along the axis and within a bore of the shaft.

6. The fan according to claim 5, wherein the tie rod is a bar of elongate shape along the axis, wherein the bar of the tie rod extends between a third longitudinal end of annular shape and a fourth longitudinal end in the shape of a T.

7. The fan according to claim 1, wherein the fan comprises an ogive-shaped annular end cap extending around said downstream cone, said end cap comprising at least one third orifice for the passage of air from said duct inside said body to said second orifices.

8. The fan according to claim 1, wherein the second air passage orifices are two to fifteen in number.

9. The fan according to claim 8, wherein the second air passage orifices are three in number.

10. The fan according to claim 1, wherein each of said second orifices has a diameter of between 3 and 20 mm.

11. The fan according to claim 10, wherein each of said second orifices has a diameter of 6 mm.

12. The fan according to claim 1, wherein the axial annular abutment disc comprises a radial extension, a first axial extension and a second axial extension which extend on either side of the radial extension, wherein the first axial extension is connected to the second longitudinal end of the shaft.

13. The fan according to claim 12, wherein the second axial extension of the annular abutment disc is inserted in a central opening of the vertical wall of the second axial annular abutment.

14. The fan according to claim 1, wherein the first axial annular abutment comprises at least one smooth sheet and at least one corrugated sheet.

15. The fan according to claim 1, wherein the second axial annular abutment comprises at least one smooth sheet and at least one corrugated sheet.

16. An aircraft comprising at least one fan according to claim 1.

* * * * *